United States Patent [19]

Franz

[11] 3,975,721

[45] Aug. 17, 1976

[54] DIFFERENTIAL RELAY ARRANGEMENT FOR DETERMINING WHEN ONE OF TWO COOPERATING LAMPS, PARTICULARLY VEHICLE LAMPS, IS NOT OPERATING

[75] Inventor: Albert Franz, Nurtingen, Germany

[73] Assignee: Hermann Stribel KG, Nurtingen, Germany

[22] Filed: July 3, 1974

[21] Appl. No.: 485,733

[30] Foreign Application Priority Data

July 10, 1973 Germany ..... 7325373

[52] U.S. Cl. ..... 340/251; 315/83; 317/155.5; 335/151; 335/177; 335/182; 335/268

[51] Int. Cl.[2] ..... G08B 21/00

[58] Field of Search ..... 340/251; 317/155.5; 335/136, 151, 177, 178, 180, 182, 266, 268, 181; 315/83

[56] References Cited

UNITED STATES PATENTS

| | | | |
|---|---|---|---|
| 1,721,177 | 7/1929 | Churcher | 335/181 |
| 2,048,623 | 7/1936 | Redinger | 335/181 |
| 2,882,367 | 4/1959 | Baker et al. | 335/181 X |
| 2,916,584 | 12/1959 | Molyneux | 335/181 X |
| 3,134,867 | 5/1964 | Winship | 335/182 |
| 3,629,799 | 12/1971 | Birtwistle | 340/251 X |
| 3,643,248 | 2/1972 | Schott | 340/251 X |
| 3,753,224 | 8/1973 | Martin | 340/251 X |

*Primary Examiner*—John W. Caldwell
*Assistant Examiner*—Daniel Myer
*Attorney, Agent, or Firm*—Michael J. Striker

[57] ABSTRACT

There is provided an indicator and a pair of cooperating vehicular lamps including a first lamp and a second lamp. An arrangement for activating the indicator when only one of the lamps is operating includes at least one cylindrical coil unit having a winding comprised of two wires including a first wire and a second wire. The first wire is connected to the first lamp in such a manner that when the first lamp is operating the first wire carries the first current producing a first magnetic field. The second wire is connected to the second lamp in such a manner that when the second lamp is operating the second wire carries a second current producing a second magnetic field which opposes and at least partly cancels out the first magnetic field. An encapsulated magnetic field responsive switch unit is comprised of a magnetic field responsive switch encapsulated in a gas-tightly sealed capsule filled with a protective gas, and is positioned in the center of the coil unit and oriented to become activated when only a single one of said fields is produced and to remain unactivated when both said fields are produced. The encapsulated switch unit is connected to the indicator. When the encapsulated switch unit becomes activated, the indicator becomes activated.

11 Claims, 8 Drawing Figures

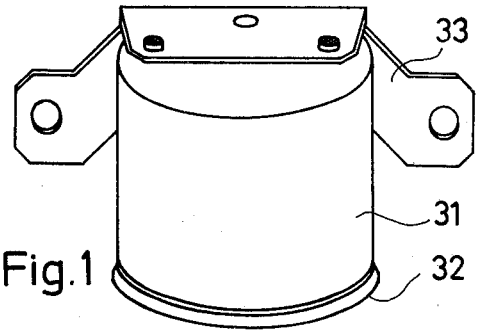
Fig.1
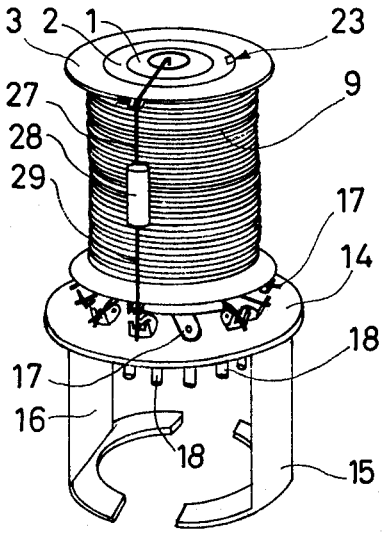
Fig. 2
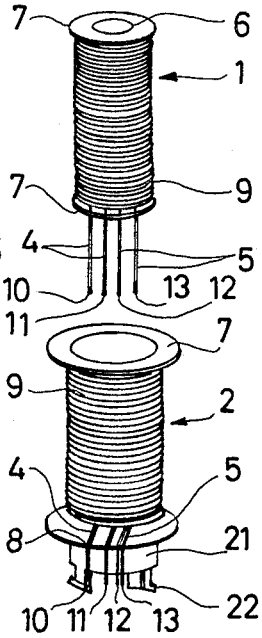
Fig.3
Fig.4
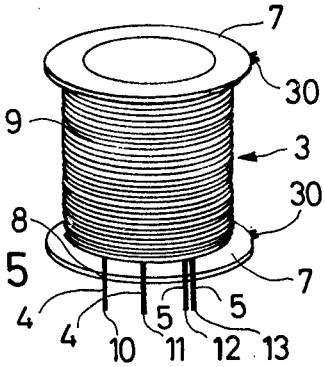
Fig.5
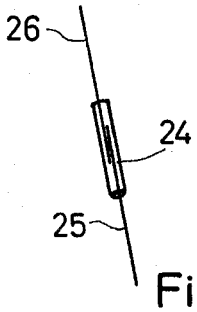
Fig.7
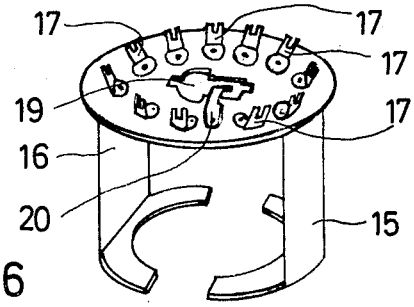
Fig.6

DIFFERENTIAL RELAY ARRANGEMENT FOR DETERMINING WHEN ONE OF TWO COOPERATING LAMPS, PARTICULARLY VEHICLE LAMPS, IS NOT OPERATING

BACKGROUND OF THE INVENTION

The invention relates to a device for monitoring the operation of lamps, particularly headlamps and tail lamps in automotive vehicles and the like, and in particular to a device of the type which applies a signal to an indicator in the event that one of the lamps being monitored becomes inoperative.

It is known to monitor the operation of pairwise arranged vehicle lamps by means of a differential relay. In such case, the relay is comprised of two windings having the same number of turns. One winding is connected in the current path of one of the lamps, and the other winding is connected in the current path of the other of the lamps. The windings are so wound and/or so connected in the current path of the respective lamps that when current flows through both the windings the magnetic field produced by the current in one winding at least partly cancels out the magnetic field produced by the current in the other winding. If one of the two lamps becomes operative, for example burns out, so that lamp current no longer flows through the current path of such lamp, then the magnetic field associated with such lamp ceases to exist, and the remaining magnetic field activates the armature of the relay thereby effecting closing of a switch which applies a signal to an indicator arrangement. Each such pair of lamps must have associated with it such a differential relay and an indicator arrangement. If only one indicator arrangement is to be used, an additional relay is required for coupling the circuit, so that considerable expense for a space-consuming arrangement is required.

SUMMARY OF THE INVENTION

It is an object of the invention to provide a device which is small and compact in construction, simple and inexpensive to manufacture, and particularly well suited for the purpose of monitoring the operation of a plurality of pairs of lamps.

This object, and others which will become more understandable from the description below of a specific embodiment, can be met, according to one advantageous concept of the invention, by providing at least one cylindrical coil comprised of a winding made up of two adjoining wires, with each wire being connected in the current pair of a respective one of two cooperating lamps, and with the two wires carrying respective currents which produce respective magnetic fields which oppose and at least in part cancel out each other, and with a magnetic field responsive switch encapsulated in a protective gas located in the center of the cylindrical coil and connected in circuit with an indicator arrangement. To monitor the operation of a plurality of pairs of lamps, a plurality of such cylindrical coils, corresponding in number to the number of lamp pairs, are required, but only a single such encapsulated magnetic field responsive switch is needed. In this way, ferromagnetic parts and the moving parts of a relay can be dispensed with, and the resulting construction is very compact. In particular, it is advantageous to wind the wires of each of the cylindrical coils around a respective supporting core, since this simplifies manufacture of the arrangement. The several cylindrical coils can be wound around respective hollow supporting cores, the cylindrical coil units being of different size so as to permit nesting of one coil unit inside the next-larger one. Advantageously, means are provided to prevent relative rotation and sliding of such concentric coil units.

It is advantageous to arrange the coil units on a base plate provided on one side with soldering lugs and on its other side with plug-and-socket type connectors. The ends of the wires and the terminals of the encapsulated switch can be soldered to the soldering lugs. The manufacture can be further simplified by providing the base plate with a recess or cutout and to provide one of the coil support cores with a base having a locking projection which engages and locks into the recess or cutout in the base plate. The other coil-support cores with the coils wound thereon are then held in place by means of the thusly locked one of the coil support cores and by means of the solder connections. A solder connection for one terminal of the encapsulated switch projects into the cutout in the base plate and into the hollow interior of the innermost coil unit, the cutout making possible the solder connection of such one terminal of the encapsulated switch. In order to prevent fusing together of the contacts of the encapsulated reed switch in the event of defects in the indicator arrangement, a current limiting resistor can be provided in the current path of the encapsulated switch. In order to complete the protection of the device, the aforedescribed coils with the encapsulated switch and the protective resistor is inserted into a cup-shaped housing provided with a mounting bracket, the open end of the cup-shaped housing being closed off by the base plate of the monitoring device.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

FIG. 1 is a perspective view of the housing of the device;

FIG. 2 is a view of the device with the housing removed;

FIGS. 3–5 depict three hollow cylindrical coil units of different size;

FIG. 6 depicts the base plate;

FIG. 7 depicts the magnetic field responsive switch encapsulated in a capsule filled with protective gas.

DESCRIPTION OF THE PREFERRED EMBODIMENTS

Figure 8:
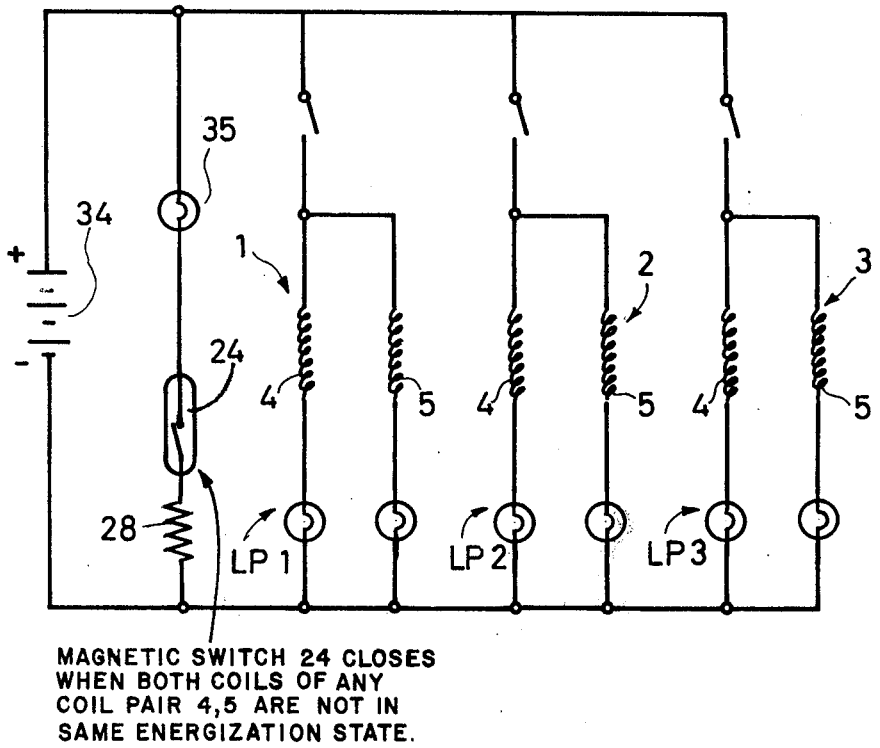
FIG. 8 depicts a complete monitoring circuit arrangement.

The illustrated device is intended for the monitoring of three pairs of lamps, and accordingly is comprised of three coil units, respectively designated 1, 2 and 3 and respectively shown in FIGS. 3, 4 and 5. The coil units fit or nest into each other. Each coil unit is comprised of two wires 4, 5 wound together around a respective common coil support core 6. The coil support core 6 is generally cylindrical and hollow and provided at its axial ends with radial flanges 7. The lower ones of the flanges 7 are provided with slits 8 for the guidance of the respective wires 4 and 5. The winding formed by the two wires 4 and 5 is very easily formed on the respective coil support core 6. Each of the lamp pairs to be monitored has associated with it one such coil unit. THe first wire 4 of each coil unit has respective ends 10 and 11 connected in the current path of one of the two lamps of the respective lamp pair. The second wire 5 of each coil unit has respective ends 12 and 13 connected in the current path of the other of the two lamps of the respective lamp pair. When current flows through both of the two wires 4, 5 of one of the coil units 1, 2, 3, because both of the respective lamps are functioning, the magnetic fields produced by the two currents oppose each other and at least partly cancel each other out.

FIG. 8 depicts a complete circuit comprised of three lamp pairs LP1, LP2, LP3 all connected across the vehicle battery 34. In the current path of each of the lamps is a respective one of the wires 4, 5 of a respective one of the coil units 1, 2, 3. The encapsulated magnetic field responsive switch 24 is connected in series with the current-limiting resistor 28 and an indicator lamp 35. If, for example, both lamp pairs LP2 and both lamps LP3 are properly operating, but only one of the lamps LP1 operates, then the switch unit 24 becomes conductive, and the indicator lamp 35 lights up. Likewise, if, for example, only the control switch associated with lamp pair LP1 is closed, and if then only one of the two lamps LP1 operates, again the switch unit 24 will become conductive and cause indicator lamp 35 to light up. Conversely, the switch 34 could be normally closed, so that the indicator lamp 35 would indicate malfunction by becoming non-illuminated.

The coil units 1, 2, 3 are arranged on an injection-molded base plate 14 provided with two springy mounting claws 15, 16 which serve to relieve tension for the connection coupling. The upper side of the base plate 14 is provided with soldering lugs 17, whereas the lower side of the base plate 14 is provided with connectors of the plug-and-socket type. In the middle of the base plate 14 there is provided a cutout 19 into which projects a soldering lug 20.

Provided on the coil support core 6 of one of the coil units 1, 2, 3—in the illustrated embodiment the coil support 6 of the coil unit 2—is a foot portion 21 provided with locking portions 22 configurated to be inserted into the cutout 19 and produce a tight anchoring of the coil unit 2 onto the base plate 14. Then, the inner coil unit 1 is inserted into the hollow interior of the coil unit 2, and the outer coil unit 3 is slid down over and around the coil unit 2. The coil units can be secured against relative rotation and slipping by suitable securing means, such as the groove and spline arrangement 23 shown in FIG. 2

Arranged in the center of the innermost coil unit 1 is an encapsulated magnetic field responsive switch unit 24 comprised of a magnetic field responsive switch gas-tightly sealed in a capsule filled with a protective gas. One terminal 25 of the encapsulated switch unit 24 is soldered to the lug 20, whereas the other terminal 26 of the switch unit 24 is soldered to a conductor 27 which leads to one terminal of a protective resistor 28. The other terminal of the resistor 28 is connected to one end of a conductor 29 the other end of which is soldered to one of the soldering lugs 17. The flanges 7 of the coil unit 3 are provided with clasps 30 which receive the conductors 27 and 29 to protect the resistor 28 from the effects of vibration.

The ends 10–13 of the wires 4, 5 of the coil units 1–3 are easily soldered to the lugs 17. Likewise, the conductor 25 is easily soldered to the lug 20. Accordingly, a very quick assembly is assured. A cup-shaped housing 31 of plastic or aluminum protects all the components from mechanical damage. The lower opening 32 of the housing 31 is closed off by the base plate 34 when the device is inserted into the housing. A mounting bracket 33 rigidly connected to the housing 31 makes it easy to mount the device on a wall of an automotive vehicle.

If both lamps of a lamp pair are in operation, then the magnetic fields produced by the currents flowing through the two wires of the respective coil unit will oppose each other and at least in part cancel each other out, so that the encapsulated switch unit 24 will remain open. However, if one of the lamps ceases to operate, so that no current flows through the respective wire, the remaining magnetic field associated with the functioning one of the two lamps will cause the encapsulated reed switch 24 to close, thereby causing indicator lamp 35 (FIG. 8) to light up. Each of the lamp pairs has associated with it a respective coil unit. If a greater number of coil units is to be employed in a relatively small space, the device can nevertheless be easily enough adapted to the number of lamp pairs to be monitored.

It will be understood that each of the elements described above, or two or more together, may also find a useful application in other types of circuits and constructions differing from the type described above.

While the invention has been illustrated and described as embodied in an arrangement for indicating non-operation of one of the lamps in a pair of cooperating vehicular headlamps or the like, it is not intended to be limited to the details shown, since various modifications and structural changes may be made without departing in any way from the spirit of the present invention.

Without further analysis, the foregoing will so fully reveal the gist of the present invention that others can by applying current knowledge readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. In combination with an indicator and at least one pair of cooperating vehicular lamps including a first lamp and a second lamp, an arrangement for activating said indicator when only one of said pair of cooperating vehicular lamps is operating, the arrangement comprising at least one cylindrical coil unit having a winding comprised of two wires including a first wire and a second wire; first means connecting said first wire to said first lamp and operative when said first lamp is operating for causing said first wire to carry a first current producing a first magnetic field; second means connecting said second wire to said second lamp and operative when said second lamp is operating for causing said second wire to carry a second current producing a second magnetic field which opposes and at least partly cancels out said first magnetic field; an encapsulated magnetic field responsive switch unit comprised of a magnetic field responsive switch encapsulated in a gas-tightly sealed capsule filled with a protective gas, the encapsulated switch unit being positioned in the center of said coil unit and oriented to become activated when only a single one of said fields is produced and to remain unactivated when both said fields are produced; and means connecting said encapsulated switch unit to said indicator and operative for activating said indicator when said encapsulated switch unit becomes activated, wherein said arrangement further includes a base plate provided with a cutout, and wherein said coil unit is provided with a foot portion provided with at least one locking portion which engages and is locked in said cutout fixedly mounting said coil unit on said base plate, and wherein said base plate is provided with a soldering lug projecting into said cutout and into the interior of said coil unit and connected to one terminal of said encapsulated switch unit.

2. The combination as defined in claim 1, wherein said base plate is made of injection-molded plastic and is provided with resilient holding jaws.

3. The combination defined in claim 1 wherein said coil unit is comprised of a winding support core, and wherein the two wires of the coil unit are both wound around the winding support core, and wherein said winding support core is provided with an axial end portion having guide slits in which are received the end portions of said wires.

4. The combination defined in claim 1, and further including a current limiting resistor connected in series with said encapsulated switch unit.

5. The combination defined in claim 1, wherein said arrangement further includes a cup-shaped housing having an open end into which said coil unit is inserted and so positioned that said base plate closes off said open end, and wherein said housing is provided with a mounting bracket.

6. In combination with an indicator and at least one pair of cooperating vehicular lamps including a first lamp and a second lamp, an arrangement for activating said indicator when only one of said pair of cooperating vehicular lamps is operating, the arrangement comprising at least one cylindrical coil unit having a winding comprised of two wires including a first wire and a second wire; first means connecting said first wire to said first lamp and operative when said first lamp is operating for causing said first wire to carry a first current producing a first magnetic field; second means connecting said second wire to said second lamp and operative when said second lamp is operating for causing said second wire to carry a second current producing a second magnetic field which opposes and at least partly cancels out said first magnetic field; an encapsulated magnetic field responsive switch unit comprised of a magnetic field responsive switch encapsulated in a gas-tightly sealed capsule filled with a protective gas, the encapsulated switch unit being positioned in the center of said coil unit and oriented to become activated when only a single one of said fields is produced and to remain unactivated when both said fields are produced; and means connecting said encapsulated switch unit to said indicator and operative for activating said indicator when said encapsulated switch unit becomes activated, wherein said arrrangement further includes a base plate provided on one side thereof with a plurality of soldering lugs and also provided with a cut-out, and wherein said coil unit is provided with a foot portion provided with at least one locking portion which engages and is locked in said cut-out fixedly mounting said coil unit on said base plate, and wherein said base plate is provided with a soldering lug projecting into said cut-out and into the interior of said coil unit, and wherein said base plate is provided with a plurality of additional soldering lugs, and wherein one terminal of said encapsulated switch unit is electrically connected to the soldering lug which projects into said cut-out, and further including a current-limiting resistor having one terminal connected to the other terminal of said encapsulated switch unit and having an other terminal electrically connected to one of said additional soldering lugs.

7. The combination defined in claim 6, wherein said coil unit is provided with radially outwardly projecting axial end flanges, and wherein the end flanges are provided with clasps receiving wires connected to the two terminals of said current-limiting resistor to thereby support said current-limiting resistor.

8. In a combination with an indicator and a plurality of pairs of vehicular lamps, each pair of lamps including a respective first lamp and a cooperating respective to second lamp, an arrangement for activating said indicator when only one of the two lamps of one of said pairs of lamps is operating, the arrangement comprising a plurality of cylindrical coil units arranged coaxially one within another and each corresponding to a respective one of said plurality of pairs of lamps and each having a respective winding comprised of two wires including a respective first wire and a respective second wire; first means connecting the first wire of each of said coil units to the first lamp of the respective one of said pairs of lamps and operative when the first lamp of the respective pair of lamps is operating for causing the respective first wire to carry a first current producing a respective first magnetic field; second means connecting the second wire of each of said coil units to the second lamp of the respective one of said pairs of lamps and operative when the second lamp of the respective pair of lamps is operating for causing the respective second wire to carry a second current producing a respective second magnetic field; an encapsulated magnetic field responsive switch unit comprised of a magnetic field responsive switch encapsulated in a gas-tightly sealed capsule filled with a protective gas, the encapsulated switch unit being positioned in the center of the innermost one of said coil units and oriented to become activated when only a single one of the two fields associated with any one of said coil units is produced; and means connecting said encapsulated switch unit to said indicator and operative for activating said indicator when said encapsulated switch unit becomes activated, wherein said arrangement further includes a base plate provided with a cutout, and wherein each coil unit is provided with a foot portion provided with at least one locking portion which engages and is locked in said cutout fixedly mounting said coil unit on said base plate, and wherein said base plate is provided with a soldering lug projecting into said cutout and into the interior of said coil unit and connected to one terminal of said encapsulated switch unit.

9. The combination defined in claim 8, wherein each coil unit is comprised of a winding support core, and wherein the two wires of each coil unit are both wound around the respective winding support core, and further including means for preventing relative movement between said coil units.

10. The combination defined in claim 8, wherein each coil unit is comprised of a hollow cylindrical winding support core, and wherein the two wires of each coil unit are both wound around the respective winding support core.

11. In a combination with an indicator and a plurality of pairs of vehicular lamps, each pair of lamps including a respective first lamp and a cooperating respective second lamp, an arrangement for activating said indicator when only one of the two lamps of one of said pairs of lamps is operating, the arrangement comprising a plurality of cylindrical coil units arranged coaxially one within another and each corresponding to a respective one of said plurality of pairs of lamps and each having a respective winding comprised of two wires including a respective first wire and a respective second wire; first means connecting the first wire of each of said coil units to the first lamp of the respective one of said pairs of lamps and operative when the first lamp of the respective pair of lamps is operating for causing the respective first wire to carry a first current producing a respective first magnetic field; second means connecting the second wire of each of said coil units to the second lamp of the respective one of said pairs of lamps and operative when the second lamp of the respective pair of lamps is operating for causing the respective second wire to carry a second current producing a respective second magnetic field; an encapsulated magnetic field responsive switch unit comprised of a magnetic field responsive switch encapsulated in a gas-tightly sealed capsule filled with a protective gas, the encapsulated switch unit being positioned in the center of the innermost one of said coil units and oriented to become activated when only a single one of the two fields associated with any one of said coil units is produced; and means connecting said encapsulated switch unit to said indicator and operative for activating said indicator when said encapsulated switch unit becomes activated, wherein said arrangement further includes a base plate provided on one side thereof with a plurality of soldering lugs and also provided with a cut-out, and wherein each coil unit is provided with a foot portion provided with at least one locking portion which engages and is locked in said cut-out fixedly mounting said coil unit on said base plate, and wherein said base plate is provided with a soldering lug projecting into said cut-out and into the interior of said coil unit, and wherein said base plate is provided with a plurality of additional soldering lugs, and wherein one terminal of said encapsulated switch unit is electrically connected to the soldering lug which projects into said cut-out, and further including a current-limiting resistor having one terminal connected to the other terminal of said encapsulated switch unit and having an other terminal electrically connected to one of said additional soldering lugs.

* * * * *